US008602069B2

(12) United States Patent
Popa et al.

(10) Patent No.: US 8,602,069 B2
(45) Date of Patent: Dec. 10, 2013

(54) SOLID CHEMICAL PRODUCT DILUTION CONTROL

(75) Inventors: Mihnea A. Popa, Inver Grove Heights, MN (US); Richard J. Mehus, Richfield, MN (US); Paul R. Kraus, Apple Valley, MN (US); Sherri L. Tischler, Inver Grove Heights, MN (US); Blake Roberts Otting, Richfield, MN (US)

(73) Assignee: Ecolab USA Inc., St. Paul, MN (US)

( * ) Notice: Subject to any disclaimer, the term of this patent is extended or adjusted under 35 U.S.C. 154(b) by 771 days.

(21) Appl. No.: 12/784,049

(22) Filed: May 20, 2010

(65) Prior Publication Data

US 2011/0284090 A1 Nov. 24, 2011

(51) Int. Cl.
*B65B 1/30* (2006.01)
*B65B 3/28* (2006.01)

(52) U.S. Cl.
CPC ..... *B65B 3/28* (2013.01)
USPC ..... 141/83; 141/102

(58) Field of Classification Search
USPC ..... 141/83, 100–105; 422/261; 222/77
See application file for complete search history.

(56) References Cited

U.S. PATENT DOCUMENTS 4,350,186 A * 9/1982 Schalkowsky et al. ..... 141/83
4,629,164 A 12/1986 Sommerville
4,764,019 A * 8/1988 Kaminski et al. ..... 366/15
4,826,661 A * 5/1989 Copeland et al. ..... 422/106
4,964,185 A * 10/1990 Lehn ..... 8/158
4,999,124 A * 3/1991 Copeland ..... 510/514
5,156,194 A * 10/1992 von Nehring et al. ..... 141/1
5,268,153 A * 12/1993 Muller ..... 422/263
5,288,145 A 2/1994 Mackey et al.
5,344,231 A 9/1994 Jönsson et al.
5,375,634 A * 12/1994 Egger ..... 141/83
5,402,834 A * 4/1995 Levin et al. ..... 141/83
5,409,713 A 4/1995 Lokkesmoe et al.
5,431,200 A * 7/1995 Mariotti ..... 141/83
5,478,537 A 12/1995 Laughlin et al.
5,515,888 A * 5/1996 Graffin ..... 141/1

(Continued)

FOREIGN PATENT DOCUMENTS

EP 0 278 100 A2 8/1988
GB 2 379 173 A 3/2003
WO 2005/070837 A1 8/2005

OTHER PUBLICATIONS

Office Action dated Jun. 4, 2012 for U.S. Appl. No. 12/862,202, 13 pp.

(Continued)

*Primary Examiner* — Timothy L Maust
(74) *Attorney, Agent, or Firm* — Shumaker & Sieffert, P.A.

(57) ABSTRACT

A solid chemical product is dispensed to prepare a requested amount of a use solution having a requested concentration of the chemical product. In some examples, a target amount of a diluent and a target amount of the chemical product required to prepare the requested use solution are determined. The target amount of the diluent is dispensed into a container. At least some of the diluent in the container is applied to the solid chemical product to create a resultant use solution, which is directed back into the container. The diluent from the container is applied to the chemical product until the amount of the use solution in the container satisfies the requested amount. In some examples, the target amount of the diluent and the target amount of the chemical product are measured by weight.

15 Claims, 8 Drawing Sheets

(56) References Cited

U.S. PATENT DOCUMENTS

| | | | | |
|---|---|---|---|---|
| 5,607,651 | A * | 3/1997 | Thomas et al. | 422/266 |
| 5,681,400 | A * | 10/1997 | Brady et al. | 134/18 |
| 5,823,670 | A | 10/1998 | Rushing et al. | |
| 6,056,027 | A * | 5/2000 | Patterson | 141/370 |
| 6,120,175 | A * | 9/2000 | Tewell | 366/140 |
| 6,143,257 | A | 11/2000 | Spriggs et al. | |
| 6,149,294 | A | 11/2000 | Jönsson et al. | |
| 6,423,280 | B1 | 7/2002 | Tarara et al. | |
| 6,793,880 | B2 | 9/2004 | Kippenhan, Jr. | |
| 6,830,367 | B2 | 12/2004 | Peterson et al. | |
| 7,110,861 | B2 | 9/2006 | Nelson et al. | |
| 7,300,196 | B2 * | 11/2007 | Fleig | 366/153.1 |
| 7,803,321 | B2 * | 9/2010 | Lark et al. | 422/62 |
| 2005/0201200 | A1 | 9/2005 | Fleig | |

OTHER PUBLICATIONS

Response to Office Action dated Jun. 4, 2012 for U.S. Appl. No. 12/862,202, filed Sep. 4, 2012, 8 pp.

International Search Report and Written Opinion for corresponding International Application No. PCT/IB2011/052039, mailed Feb. 8, 2012, 7 pp.

* cited by examiner

SOLID CHEMICAL PRODUCT DILUTION CONTROL

TECHNICAL FIELD

The disclosure relates generally to chemical product dispensing.

BACKGROUND

Automated chemical product dispensers are useful in many different chemical application systems, including cleaning systems relating to food and beverage operations, laundry operations, warewashing operations (e.g., dishwashers), water treatment operations, pool and spa maintenance, as well as other systems, such as agricultural operations. For example, chemical products used in food and beverage operations may include sanitizers, sterilants, cleaners, degreasers, lubricants, etc. Chemical products used in a warewashing or laundry operation may include detergent, de-ionized water, sanitizers, stain removers, rinse agents, etc. Chemical products used in a laundry operation may include detergent, bleaches, stain removers, fabric softeners, etc. Chemical products used in agriculture may include without limitation pesticides, herbicides, hydration agents, and fertilizers. Chemical products used in cleaning of medical/surgical instrumentation may include detergent, cleaning products, neutralizers, sanitizers, disinfectants, enzymes, etc. Other chemical products may include without limitation glass cleaning chemicals, hard surface cleaners, antimicrobials, germicides, lubricants, water treatment chemicals, rust inhibitors, etc.

Automated chemical product dispensers can reduce labor and chemistry costs by automatically delivering predetermined amounts of chemicals in a proper sequence and in proper amounts, often times in very large quantities or at high speeds. Furthermore, some chemical products can be hazardous in concentrated form; therefore, automated chemical product dispensers reduce the risks of exposure to operators, who may otherwise measure and deliver the chemical products manually.

Product dispensers dispense a wide variety of chemical products in a variety of different forms. Some dispensers dispense products in liquid, gel or powder form. Other dispensers may use a water spray to gradually dissolve a solid product to create a use solution. The chemical product may be dispensed to a dispensing site, such as a container (bucket, pail, tank, storage tank, etc.), wash environment (dishwasher, laundry machine, medical/surgical instrument washer, car wash, etc.), machinery (food or beverage processing equipment, manufacturing facility, etc.), or other environment in which the chemical product is to be used.

SUMMARY

In general, the disclosure relates to dispensation of chemical products. In some examples, a solid chemical product is dispensed to prepare a requested amount of a use solution having a requested concentration of the chemical product. In some examples, a target amount of a diluent and a target amount of the chemical product required to prepare the requested use solution are determined. The target amount of the diluent is dispensed into a container. At least some of the diluent in the container is applied to the solid chemical product to create a resultant use solution, which is directed back into the container. The diluent from the container is applied to the chemical product until the amount of the use solution in the container satisfies the requested amount. In some examples, the target amount of the diluent and the target amount of the chemical product are measured by weight.

In one example, the disclosure is directed to a method comprising dispensing a target amount of a diluent into a container and applying at least some of the diluent from the container to a solid chemical product and directing the resulting use solution back into the container until an amount of the use solution in the container satisfies a requested amount.

In another example, the disclosure is directed to a system comprising a container into which a target amount of a diluent required to prepare a requested amount of a use solution is dispensed, a weighing device positioned to obtain container weight information concerning a weight of the container and any contents thereof, and a controller that receives a dispense request specifying a requested volume of the use solution to be prepared and a requested concentration of the chemical product in the use solution, determines a target weight of the diluent required to prepare the requested use solution, determines a target weight of the chemical product to be dispensed required to prepare the requested use solution, and manages application of the diluent onto the solid chemical product until an amount of the use solution in the container satisfies the requested amount based on the container weight information.

The details of one or more examples are set forth in the accompanying drawings and the description below. Other features and advantages will be apparent from the description and drawings, and from the claims.

DETAILED DESCRIPTION

In general, the disclosure relates to dispensation of chemical products. In some examples, a solid chemical product is dispensed to prepare a requested amount of a use solution having a requested concentration of the chemical product. In some examples, a target amount of a diluent and a target amount of the chemical product required to prepare the requested use solution are determined. The target amount of the diluent is dispensed into a container. At least some of the diluent in the container is applied to the solid chemical product to create a resultant use solution, which is directed back into the container. The diluent from the container is applied to the chemical product until the amount of the use solution in the container satisfies the requested amount. In some examples, the target amount of the diluent and the target amount of the chemical product are measured by weight.

Figure 1:
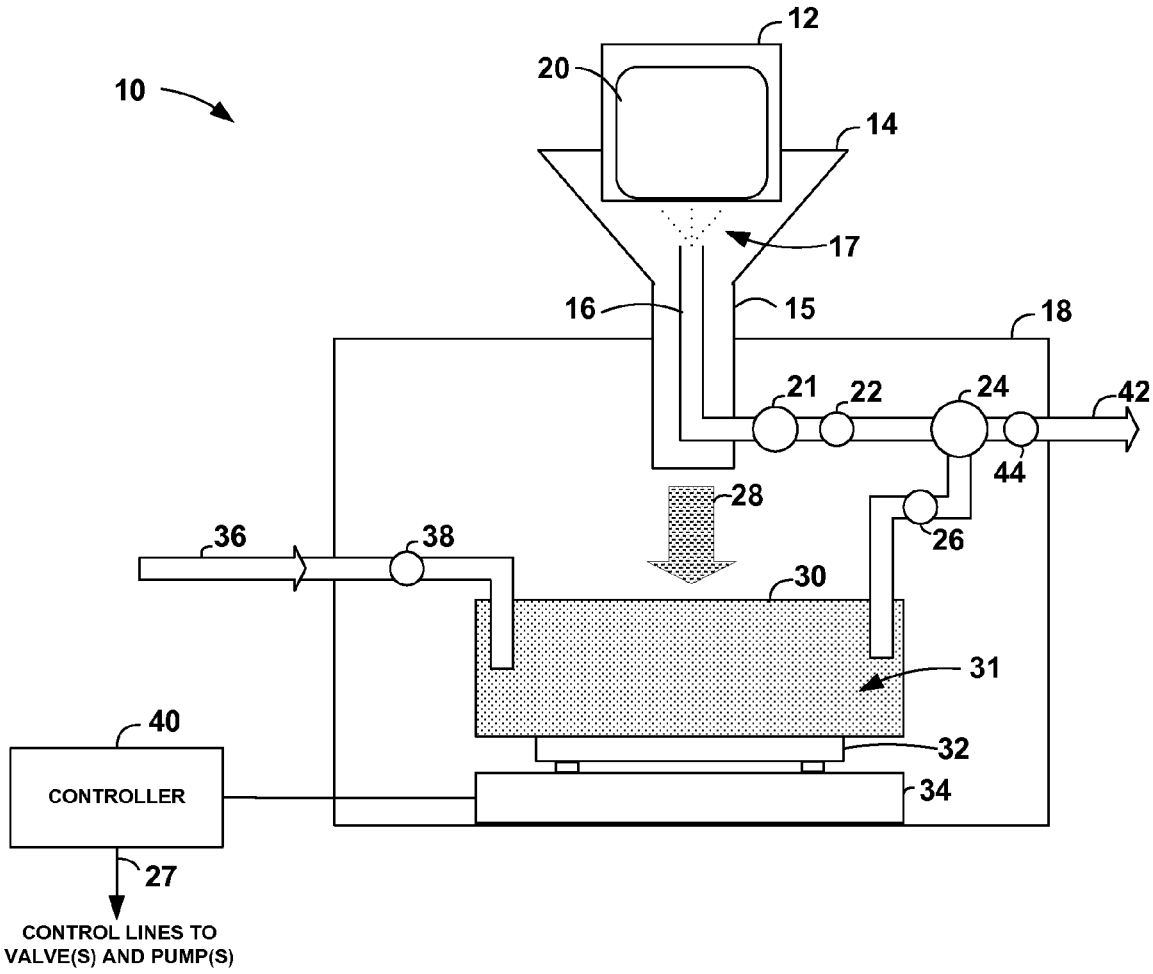
FIG. 1 is an illustration of an example dispensing system in which the contents of a container are recirculated and used to dispense a solid chemical product concentrate to create a use solution of a desired concentration in the container.
Figure 2:
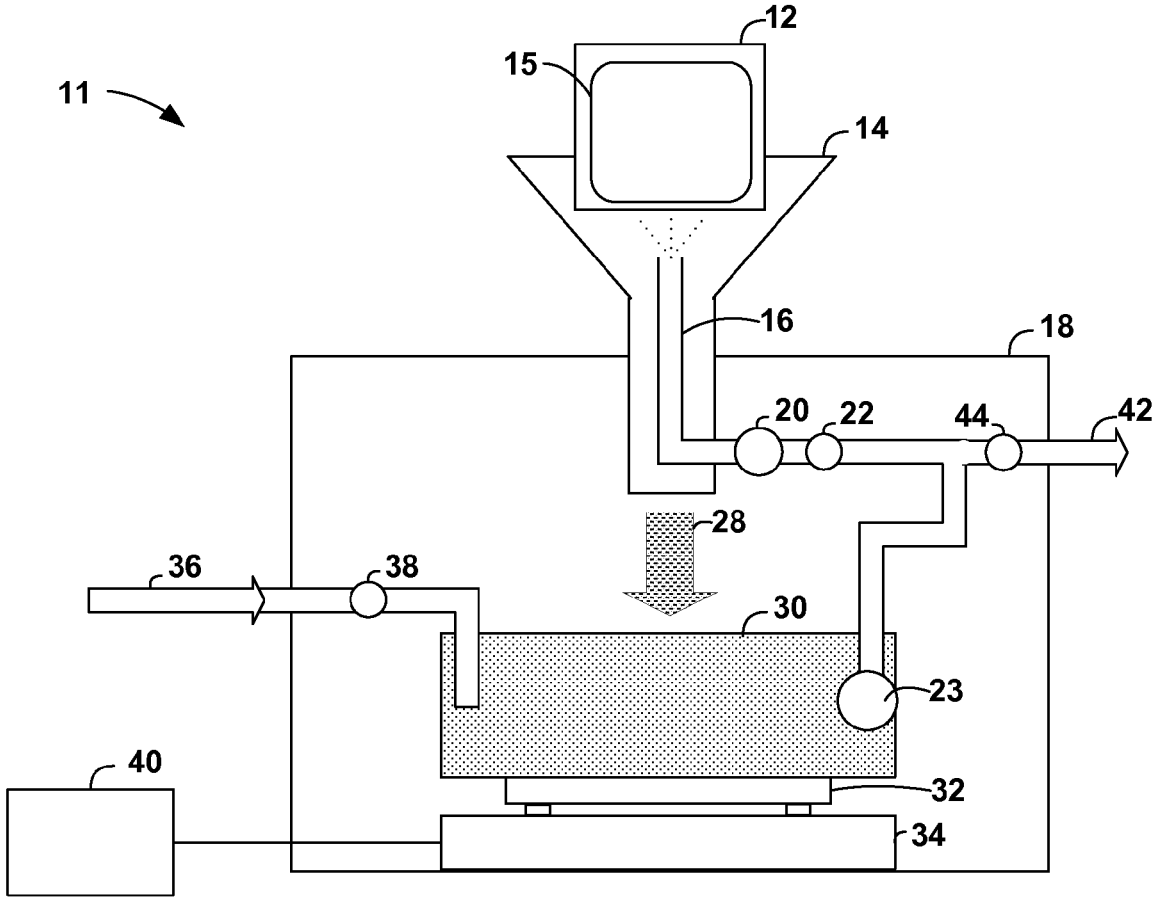
FIG. 2 is a diagram of another example dispensing system in which the contents of a container are recirculated and used to dispense a solid chemical product concentrate to create a use solution of a desired concentration in the container.

FIG. 1 is an illustration of an example dispensing system 10 in which the contents of a container 30 are applied to a solid chemical product 20 to prepare a requested use solution. System 10 includes a container 30 into which the use solution is prepared, a weight measurement 32 that measures the weight of the container and its contents, a dispenser housing 14 that receives a solid chemical product 20, and a liquid circulation sub-system that draws diluent from the container and sprays the diluent onto a solid chemical product to be dispensed and directs the resulting use solution back into the container. The liquid circulation subsystem includes an assortment of valves (e.g., valves 22, 26, 38, 44) and pumps (12, 24) and piping that circulate the contents 31 of container 30 and apply them to chemical product 20 to prepare the use solution. Although particular arrangements of the liquid circulation subsystem are shown in FIGS. 1 and 2, it shall be understood that these are examples only and that any other arrangement capable of accomplishing the liquid circulation task could be used, and that the disclosure is not limited in this respect.

Contents 31 of container 30 may at various times include diluent only, the use solution in various stages of being prepared, or the final, full strength use solution. A controller 40 manages overall operation of system 10 including initiating and controlling operation of the dispensing cycles, controlling the various valves and pumps in the system, receiving and processing the weight information from weight measuring instrument 32, etc. The pump or pumps may be direct lift, displacement, velocity, buoyancy and/or gravity pump(s) or any combination thereof.

In some examples, controller 40 may receive a dispense request specifying a requested volume of the use solution to be prepared and a requested concentration of the chemical product in the prepared use solution. From this information, controller 40 determines a target weight of the diluent required to prepare the requested use solution, and determines a target weight of the chemical product required to prepare the requested use solution.

The dispense requests may be entered by a user and/or may be electronically stored in a memory. For example, a user may enter a dispense request specifying the amount of use solution to be prepare and the concentration of the requested use solution. As another example, controller 40 may store a programmed sequence of dispense requests to be prepared at certain times of day or in a predefine sequence. As another example, a dispense request may be automatically generated when it is determined that more use solution is needed. For example, if use solution is being drawn out of container 30 on an as needed basis, an out-of-product sensor may detect when the container is empty or nearing empty. The out-of-product sensor may then automatically generate a dispense request. Similarly, if container 30 is drawn from in known quantities, a dispense request may be automatically generated after a certain number of draws known to empty the container have occurred. Thus, it shall be understood that any manual or automatic mechanism for initiating a dispense request may be used, and that the disclosure is not limited in this respect.

Controller 40 may also store one or more dispenser settings corresponding to preparations of multiple use solutions. For example, settings required to prepare use solutions of different volumes/concentrations may be stored for one or more chemical products including detergent, sanitizer, rinse agent, bleach, disinfectant, etc. Also, multiple different target concentrations may be stored for each cleaning agent depending upon the items that the use solution will be cleaning. For example, cleaning of medical instrumentation may require a higher concentration of disinfectant than cleaning of dishware, etc.

In use, solid chemical product 20 is loaded into a dispenser housing 14. Chemical product 20 may or may not be packaged in a product capsule or other packaging 12. Housing 14 includes an inlet 16 having a spray nozzle (not shown) through which diluent/use solution 20 from container 30 is sprayed onto chemical product 20. The spray 17 dissolves and/or erodes the solid chemical product to form a use solution which is collected in container 30 as indicated by arrow 28. If chemical product 20 is packaged in a product capsule 12 or other product packaging, that packaging may include appropriately placed openings so that the chemical product may be exposed to the diluent spray 17 and so that the use solution may exit the product capsule. Housing 14 also includes an outlet 15 through which use solution exits housing 14 and is directed into container 30 as indicated by arrow 28.

In these examples, chemical product 20 may be a solid chemical product concentrate and can take any of a number of forms, such as a solid block of chemical product concentrate, pellets, tablets, a cast product, an extruded product, or other form of solid chemical product.

Weighing device 34 is positioned to measure the weight of container 30 and its contents 31 and communicates the container weight information to controller 40. Container 30 and weighing device 34 may be surrounded by an enclosure 18, which may help to prevent contaminants from entering the prepared use solution. The system may also include a support 32 for container 30.

Weighing device 34 may include any type of weighing scale capable of determining the weight or mass of an object. For example weighing device 34 may be implemented using one or more load cells, strain gauges, a spring scale, an analytical scale, a hydraulic scale, a pneumatic scale, or any other device or apparatus capable of measuring the weight or mass of an object.

In some examples, one or more load beams could be used to measure the weight of the container 30. For example, a two load beam weighing device could obtain the weight of the container and the diluent/use solution therein and provide analog strain signals to a circuit board that conditions and converts these measurement into a single calibrated mass value. Such a dual beam layout may be arranged so that a drain could be placed in the bottom of or on the lower portion of one of the sidewalls of the solution container 30 to drain the contents out the bottom and through components 32 and 34. In this example, solution container 30 may be sloped towards the drain and would allow gravity to dispense the solution out of the dispenser. This example implementation could also be used as a secondary drain mechanism for evacuating the solution container prior to preparing another solution. An implementation using more than two load beams could also be arranged so as to permit drainage of the contents of the container.

It shall be understood that any automated mass measurement device/system could be made to work with this application, and the disclosure is not limited in this respect. For example, a commercial-off-the-shelf (COTS) scale or mass balance or a customized weighing device could also be used.

Controller 40 may store calibration information so as to take the weight of the empty container, support 32 (if any) and/or other objects affecting the container weight information into account when determining the weight of the diluent/use solution in the container.

Controller 27 is connected via control lines 27 to one or more valve(s) and/or pump(s) to control when and how much diluent is dispensed into container 30, and to control when and how much diluent from the container is applied to the chemical product. For example, valve 38 controls the dispensation of diluent into container 30 from a diluent source (not shown). Pump 24 pumps at least some of the contents (the diluent/use solution) of container 30, via optional check valve 26, through spray valve 22 and pressure regulator 21 to produce the diluent spray 17. A dispense valve 44 permits the use solution to be pumped via pump 24 to another destination, such as a day storage tank, cleaning machine, or other destination. In addition or alternatively, a drain could be placed near the bottom of container to allow gravity to drain the diluent or use solution from the container.

System 10 produces a use solution of a requested amount and a requested concentration. The requested amount (usually, but not necessarily, requested in terms of volume) of use solution and the requested concentration of the use solution may be entered via a user interface or may be stored in a controller memory. For example, system 10 may include a user interface that presents a variety of preprogrammed use solutions from which the user may select. As another example, the user interface may permit the user to enter parameters (e.g., volume, weight, and/or concentration of the requested use solution) for a customized use solution. As another example, the system may be programmed to automatically generate use solution(s) of desired volume(s) and concentration(s) at prescheduled times or at periodic intervals. Once the requested amount and the requested concentration of use solution are known, controller 40 controls the various valve(s) and pump(s) in the system to prepare the requested use solution, which is collected in container 30.

For example, if the requested amount (volume and/or weight) of use solution and the requested concentration of the use solution are known, the target amount (weight) of chemical product required to prepare the requested use solution may be determined as follows:

$$\text{Product}_{target}(\text{g})=\text{Conc}_{target}(\text{g/L})*\text{UseSol'n}_{target}(\text{L}),$$
where $\text{Product}_{target}$ (g) is the target weight of chemical product to be dispensed in grams, $\text{Conc}_{target}$ (g/L) is the requested concentration of the use solution in grams/liter, and $\text{UseSol'n}_{target}$ (L) is the requested volume of use solution to be prepared in liters.

From the requested volume of use solution and target weight of chemical product, a target amount (weight) of diluent required to prepare the requested use solution may be determined as follows:

$$\text{Diluent}_{target}(\text{g})=\text{UseSol'n}_{target}(\text{g})-\text{Product}_{density}(\text{g}),$$
where $$\text{Use Sol'n}_{target}(\text{g})=\text{UseSol'n}_{target}(\text{L})*\text{Product}_{density}(\text{g/L}),$$
where $\text{Product}_{density}$ (g/L) is the density of the chemical product in grams per liter.

Once the target weight of diluent is determined, controller 40 activates valve 38 so that diluent is directed into container 30 in the direction indicated by arrow 36. During dispensation of the diluent, weighing device 34 samples the weight of the container 30 at periodic intervals. Once the difference between the target weight of the diluent and the weight of the diluent in the container satisfies a threshold, controller 40 deactivates valve 38 so as to shut-off the supply of diluent.

To dispense the target weight of chemical product into the contents of container 20, and thus to produce the requested use solution, system 10 applies at least some of the contents of container 30 (via optional check valve 26) to the chemical product via spray 17. During dispensation of the chemical product, weighing device 34 samples the weight of the container 30 at appropriate times. When the difference between the requested amount of use solution and the weight of the use solution in the container satisfies a threshold, system 10 stops the application of diluent/use solution to the chemical product so that no additional chemical product is dispensed. A settling time may follow to allow any remaining diluent/use solution in dispenser housing 14 and/or product capsule 12 to drain into the container 30.

FIG. 2 is a diagram of another example dispensing system 11 in which the contents of a container are recirculated and used to dispense a solid chemical product concentrate to create a use solution of a desired concentration in the container. Example system 11 is the same as example system 10 except that system 11 includes a submersible pump 23.

Figure 3:
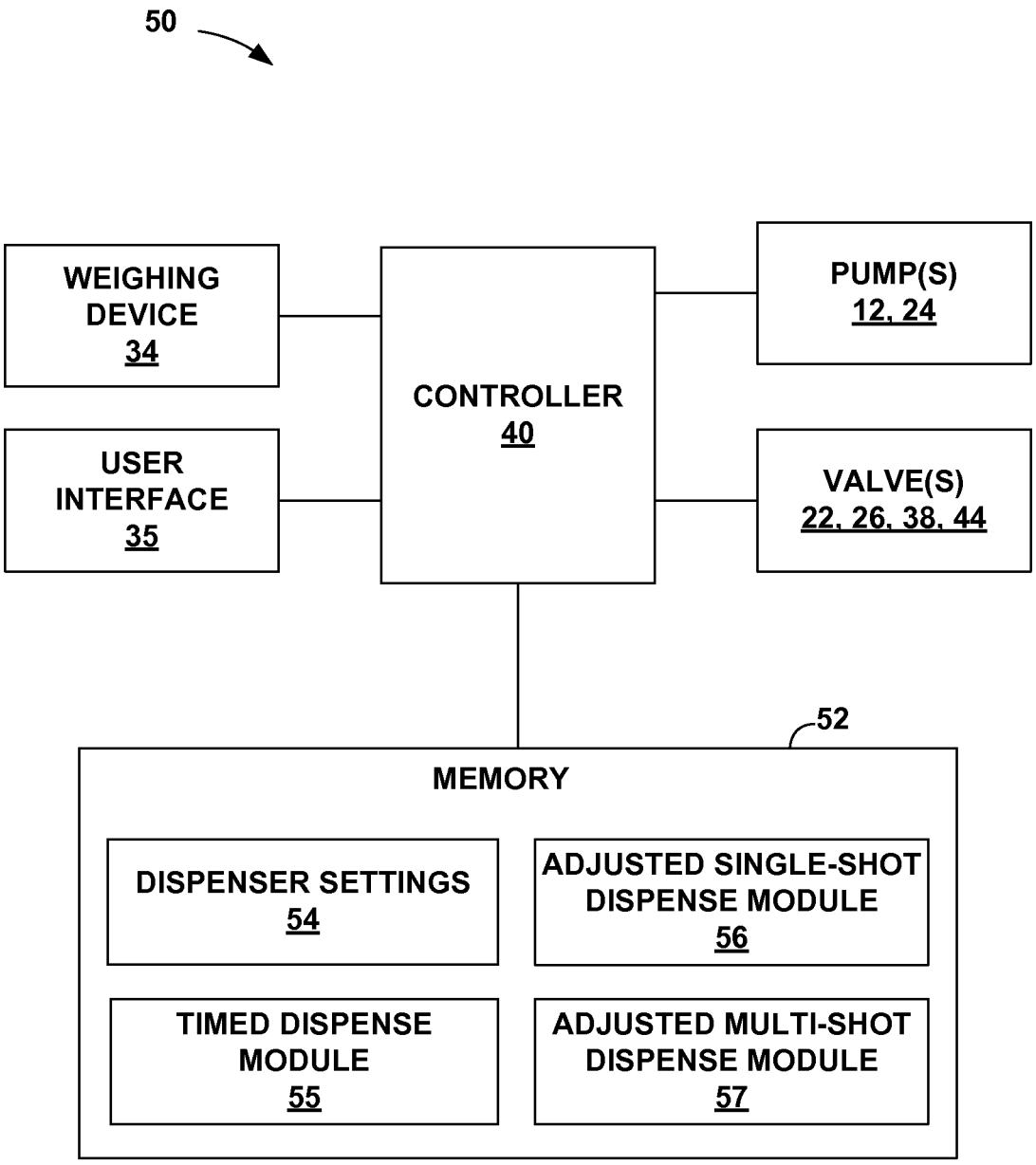
FIG. 3 is a block diagram illustrating an example implementation of the electronic components of the dispensing system.

FIG. 3 is a block diagram illustrating the electronic components 50 of a dispensing system such as system 10 or 11. Controller 40 is connected to control the operation of electronically controlled pumps (such as pumps 12 and 24) and valves (such as valves 22, 26, 38, and 44). Controller 40 also receives container weight information from weighing device 34. A user interface 35 may permit users to start and/or stop operation of the system, program various dispenser settings, enter parameters for the preparation of customized use solutions, select from a menu of preprogrammed use solutions, select from a menu of dispensing modes, perform maintenance and troubleshooting operations, etc. A memory 52 stores software modules that control the various operations and functions of the system, such as dispenser settings 54.

Memory 52 may also store software modules corresponding to one or more dispensing modes. The dispensing modes provided by the system may include, for example, a timed dispense mode, an adjusted single-shot dispense mode, an adjusted multi-shot dispense mode, and/or other dispensing modes. Memory 52 may store corresponding software modules, such as a timed dispense module 55, an adjusted single-shot module 56, an adjusted multi-shot module 57, and/or or software modules corresponding to other dispensing modes that may be employed. Depending upon the use solution to be prepared, use of different dispensing modes may provide for faster use solution preparation and/or increased use solution concentration accuracy.

Figure 4:
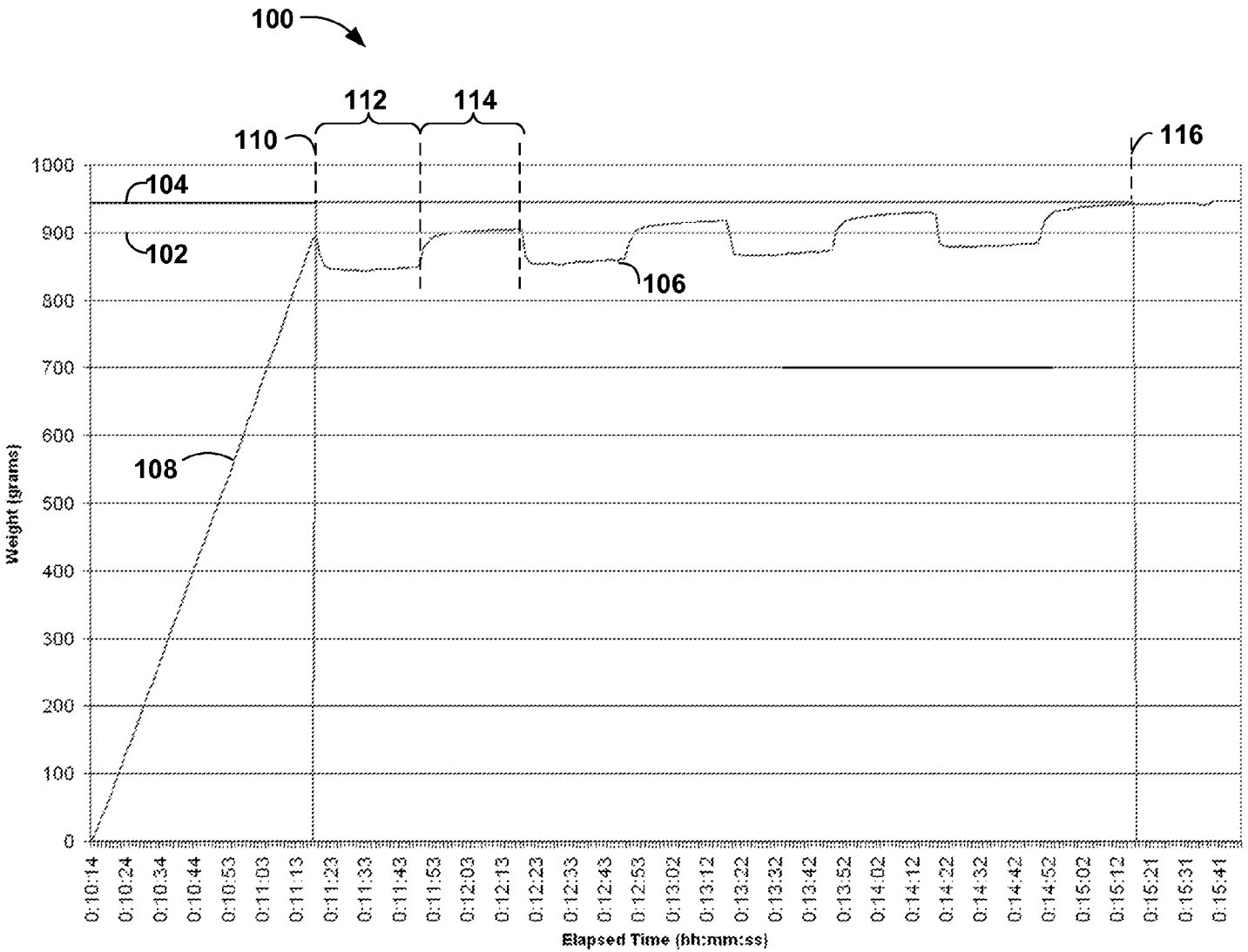
FIG. 4 is an example graph of product weight dispensed vs. time for the timed dispense process.

FIG. 4 is a chart illustrating an example dispensing cycle 100 for the timed dispense mode. In general, the timed dispense module controls dispensation based on application of the diluent to the solid block of chemical product for a predetermined amount of time calculated to achieve the requested amount of use solution. The mantissa is time and the ordinate is weight in grams. Reference numeral 102 is the target weight of diluent to be dispensed into the container. Reference numeral 104 is the target weight of the combined diluent and chemical product in the container (in other words, the target weight of the prepared use solution). In this example, the requested volume of use solution is 1 liter (or 1000 grams as indicated by reference numeral 104, assuming a density of 1 g/L). The requested concentration is 50 g/L. Thus, in this example, the target weight of the diluent is 950 grams and the target weight of chemical product to be dispensed is 50 grams, for a total use solution target weight of 1000 grams.

Starting at time t=0, the portion of the graph indicated by reference numeral 108 reflects the weight of the container as it is being filled with diluent. Once the target weight of diluent is obtained at time 110, the diluent source valve is turned off to prevent further diluent from entering the container. Also at this time (or at some later time in other examples), a spray on/off cycle is initiated. For example, during the time frame indicated by reference numeral 112, at least some of the contents of the container (the diluent) are drawn from the container and sprayed onto the chemical product for a first predetermined period of time. Thus, during time 112, the weight of the container initially decreases, reflecting the fact that some of the contents are being circulated to dispense chemical product. After a minimum weight is reached, the weight of the container begins to increase, reflecting the fact that some chemical product has been dispensed into the container.

During time frame 114, the spray of diluent is stopped for a second predetermined period of time. The first and second predetermined periods of time may be the same of they may be different. During time 114, the weight of the container increases, reflecting the fact that all of the diluent has been returned to the container and that some chemical product has been dispensed into the container (which at this point will contain at least a partially prepared (weak) use solution). As indicated by reference numeral 106, starting at time 110, the system cycles the spray on and off at predetermined intervals. At time 116, the total weight of diluent and dispensed chemical product in the container satisfies the desired amount of use solution, and the spray on/off cycle is stopped.

Figure 5:
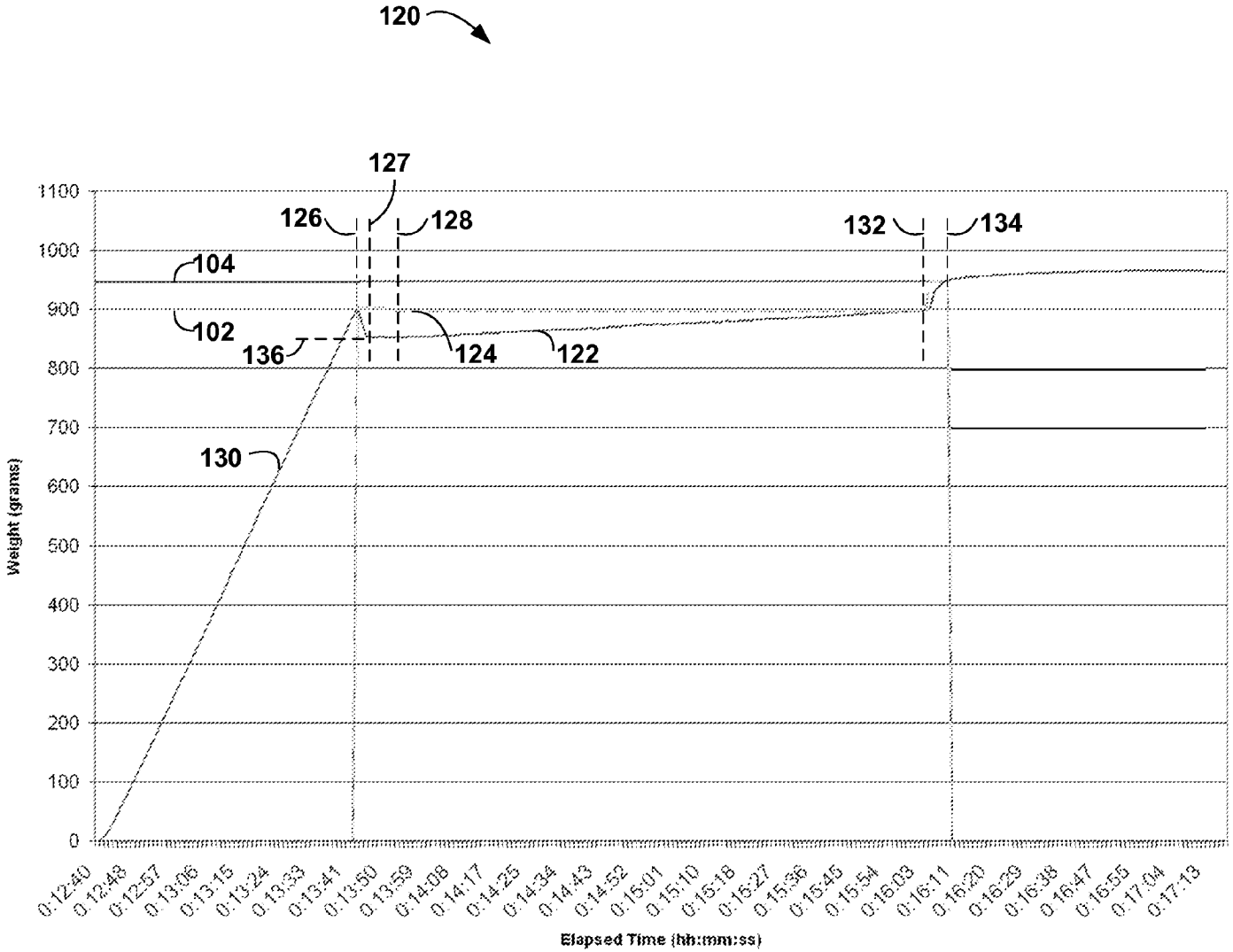
FIG. 5 is an example graph of product weight dispensed vs. time for the adjusted single shot dispense process.

FIG. 5 is a chart illustrating an example dispensing cycle 120 for the adjusted single-shot dispense mode. The mantissa is time and the ordinate is weight in grams. Reference numeral 102 is the target weight of diluent to be dispensed into the container. Reference numeral 104 is the target weight of the diluent and the chemical product in the container (in other words, the target weight of the prepared use solution). In this example, the requested volume of use solution is 1 liter (or 1000 grams as indicated by reference numeral 104, assuming a density of 1 g/L). The requested concentration is 50 g/L. Thus, in this example, the target weight of the diluent is 950 grams and the target weight of chemical product to be dispensed is 50 grams, for a use solution target weight of 1000 grams.

Starting at time t=0, the portion of the graph indicated by reference numeral 130 reflects the actual weight of the diluent as the container is being filled. Once the target weight of diluent is obtained at time 126, the actual weight of the diluent in the container at time 126 is stored and the diluent source valve is turned off to prevent further diluent from entering the container. Also at this time (or at some later time in other examples), the contents of the container (the diluent) are drawn from the container and sprayed onto the chemical product. Thus, starting at time 126 and for a certain period of time after, the weight of the container decreases, reflecting the fact that some of the container contents have been removed from the container and are being applied to dispense the chemical product.

After some amount of time, indicated by reference numeral 127, the weight of the container has reached a minimum and starts to increase. This reflects the fact that chemical product has been dispensed into the container. Reference numeral 136 indicates the minimum weight of the container at time 127 after which the weight of the container again starts to increase due to addition of chemical product. The difference between the actual weight of the diluent at time 126 and the minimum weight 136 at time 127 is referred to herein as the spray-mass loss.

The slope of curve 122 increases in a substantially linear fashion from time 127 as the dispensing cycle continues and as more and more chemical product is dispensed into the container. That is, the weight of the container increases as the concentration of the use solution increases. The slope of curve 122 at any particular time after time 127 represents the dispense rate, i.e., the weight of chemical product dispensed per unit time. In most cases, this slope will be relatively constant throughout each dispensing cycle. Thus, the dispense rate can be used to predict the time after the dynamic settling time at which the dispensing spray should be discontinued in order to dispense a target weight of the chemical product into the use solution.

At a predetermined time after the weight of the container begins to rise (here indicated by reference numeral 128 and referred to herein as the dynamic settling time), the slope of curve 122 between time 127 and 128 may be calculated. The slope may be calculated at one point in time or may be averaged over two or more points in time. The slope corresponds to the dispense rate. The dispense rate may be used to determine a single-shot dynamic target and a corresponding amount of time (as measured from the dynamic settling time) that the chemical product should be sprayed with diluent in order to dispense the target amount of chemical product. At the end of the time determined by the single-shot dynamic target (here indicated by reference numeral 132) the dispensing spray is turned off. A short wait time may follow to allow any remaining diluent/use solution in dispenser housing 14 and/or product capsule 12 to drain into the container 30. This results in a corresponding increase in the weight of the container as the remaining use solution drains into the container as indicated by curve 122 between time 132 and time 134. At time 134, the weight of the use solution in the container approaches the target weight of the use solution, and the adjusted single-shot dispensing cycle is complete.

The single-shot dynamic target (indicated in the example of FIG. 5 by dashed line 124) may be computed so as to take into account the spray-mass loss; that is, the difference between the actual weight of the diluent in the container at time 126 and the minimum weight of the use solution in the container 136 at time 127. The spray-mass loss represents the weight of the diluent/use solution drawn from the container and that is being circulated throughout the system to dispense the chemical product. As a result, during the spraying of the chemical product, this portion of the diluent/use solution is not present in the container to contribute to the total weight of diluent/use solution in the container. Once the spray of the chemical product has begun, initially the weight of the container decreases as shown between times 126 and 127. After a period of time, an equilibrium point between the weight of the diluent/use solution from the container being used to dispense the chemical product and the weight of the diluent/use solution re-entering the container from the dispenser housing will be reached. This equilibrium point is represented by the spray-mass loss.

The system may take the spray-mass loss into account when calculating the single-shot dynamic target by determining the difference between the total target weight of the use solution 104 and the spray-mass loss. Thus, in FIG. 5, the dynamic target indicates that the spray should be turned off at time 132, which is the predicted time at which the weight of the container equals difference between the total target weight of the use solution and the spray-mass loss (e.g., the difference between the target weight of the diluent 102 and the minimum weight 136 of the use solution in the container). When the time associated with the dispense rate has elapsed (indicated by time 134) of the adjusted single-shot mode shown in FIG. 5, it may be assumed that the use solution satisfies the desired volume and concentration.

If increased accuracy in the resulting use solution concentration is desired, the process used for the adjusted single-shot mode may be repeated any number of times until a desired threshold is satisfied. This dispensing mode is referred to herein as the adjusted multi-shot dispensing mode. In adjusted multi-shot mode, a multi-shot dynamic target may be calculated instead of the single-shot dynamic target described above. For example, the multi-shot dynamic target may be determined based on a predetermined percentage of the single-shot dynamic target described above. For example, to calculate the multi-shot dynamic target, the system may determine the predetermined percentage of the difference between the total target weight of the use solution and the spray-mass loss. The predetermined percentage may be, for example, 80%, 85%, 90%, 95%, or other appropriate percentage. This process may be repeated as many times as desired. During each iteration, a new multi-shot dynamic target may be calculated, until a desired threshold is satisfied. For example, the multi-shot dispensing mode may include two more spray cycles in which the percentage becomes closer to the target weight of the use solution until the target weight is obtained. For example, the multi-shot dispensing mode may include two, three, four, or more spray cycles.

The threshold for determining whether the target weight of the use solution has been reached may be defined in a variety of ways. For example, the threshold may define a minimum weight of the use solution in the container corresponding to a prepared use solution having a minimum acceptable concentration of chemical product. This may be the case in applications where a minimum use solution concentration is required in order to comply with standards set by the government, the industry, a particular company, or other standard promulgating body. For example, disinfecting of medical-based instrumentation or food processing equipment may require a minimum concentration of disinfectant solution to ensure that adequate disinfection takes place. As another example, the threshold may define a range for the weight of the use solution in the container corresponding to an acceptable use solution concentration. The threshold may be expressed in terms of an acceptable absolute difference between the target weight and the actual weight, as an acceptable percentage difference, or other means of expressing a threshold.

Figure 6:
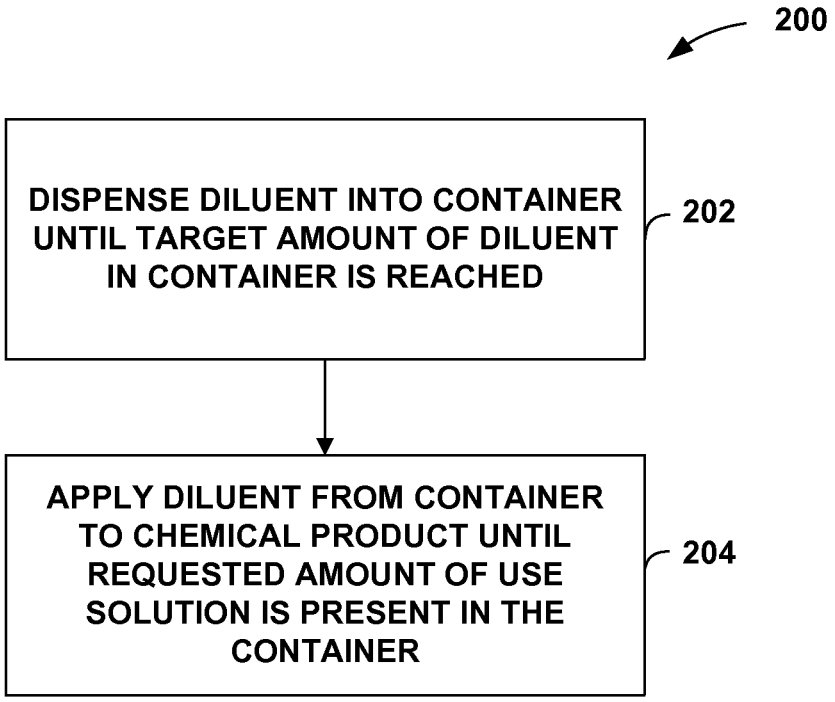
FIG. 6 is a flow chart illustrating an example process by which the system may create a use solution of a desired concentration.

FIG. 6 is a flow chart illustrating an example process (200) by which a dispensing system may prepare a requested amount of a use solution having a requested concentration of a chemical product. A controller, such as controller 40, may cause diluent to be dispensed into the container until the target amount of diluent the container is reached (202). The controller may then apply diluent from the container to the solid chemical product until the requested amount of use solution is present in the container (204). Process (200) may encompass the timed dispense mode, the adjusted single-shot dispense mode, the adjusted multi-shot dispense mode, or other dispense modes known to those of skill in the art. For example, the process may encompass other predictive dispense modes, other iterative dispense modes, make-up dispense modes, etc. For example, the processes described in any of U.S. Pat. No. 7,201,290, to Mehus et al., issued Apr. 10, 2007; U.S. Pat. No. 7,410,623, to Mehus et al., issued Aug. 12, 2008; U.S. patent application Ser. No. 10/843,230, to Mehus et al., filed May 11, 2004; U.S. patent application Ser. No. 11/713,964, to Mehus et al., filed Feb. 28, 2007; U.S. patent application Ser. No. 10/4363,454, to Mehus et al., filed May 12, 2003; and/or U.S. patent application Ser. No. 12/567,266, to Buck et al., filed Sep. 25, 2009, each of which is incorporated herein by reference in its entirety, could be used in conjunction with the techniques described herein.

Figure 7:
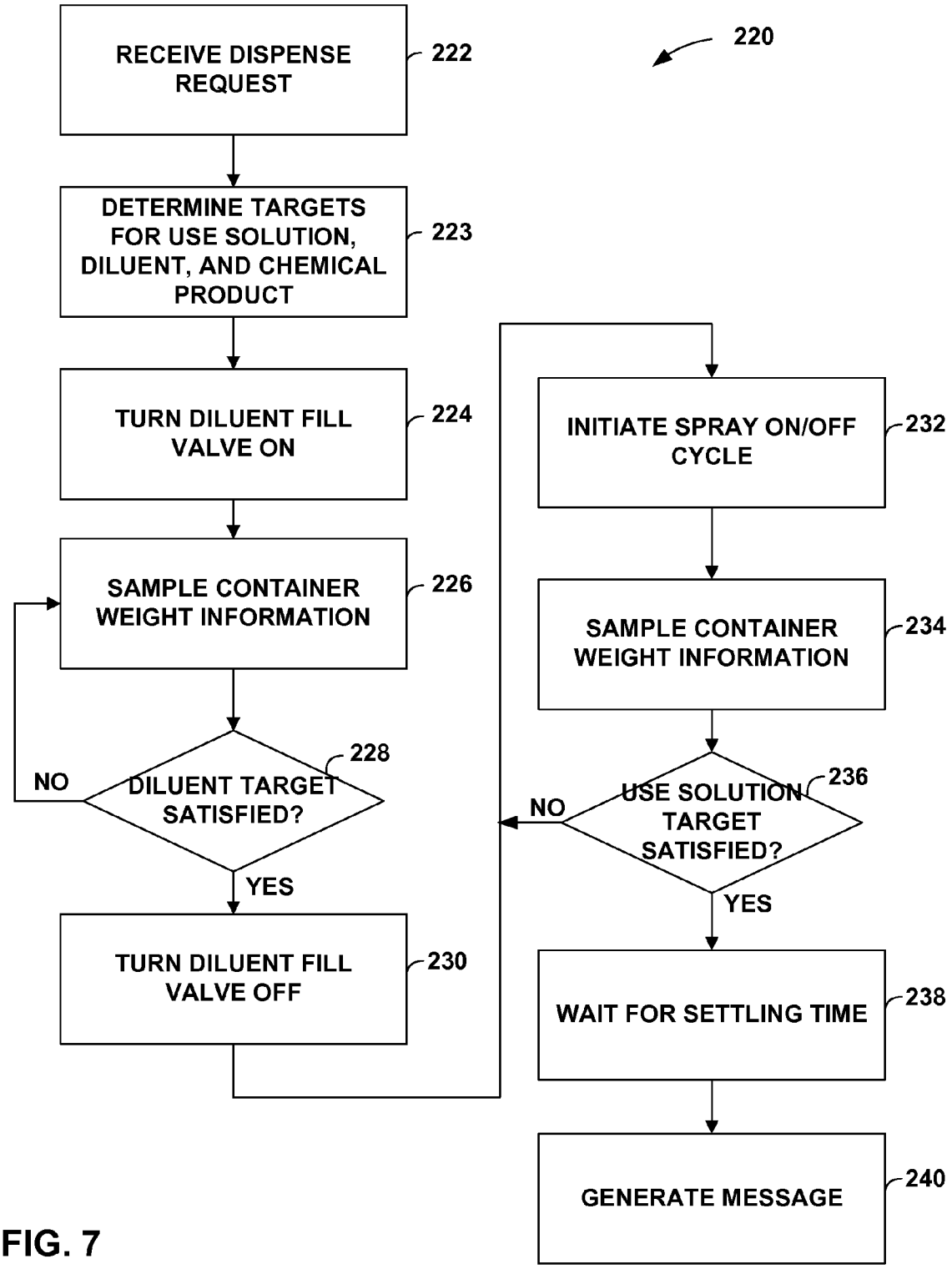
FIG. 7 is a flow chart illustrating an example timed dispense process by which the system may create a use solution of a desired concentration.

FIG. 7 is a flow chart illustrating an example process (220) by which a dispensing system may prepare a use solution using the timed dispense mode. The system controller receives a dispense request (222). The controller determines the target weight of the requested volume of the use solution, the target weight of the diluent to be dispensed into the container required to prepare the requested use solution, and the target weight of the chemical product to be dispensed into the container required to prepare the requested use solution (223). The controller turns on the diluent fill valve (224). The controller samples the container weight information (226) until for the target weight of diluent to be dispensed into the container been reached (228). The controller turns off the diluent fill valve (230).

The controller next initiates a spray on/off cycle in which diluent from the container is applied to the chemical product for a first predetermined period of time, and then the spray is turned off for a second predetermined period of time. This process repeats until the amount of use solution in the container satisfies the requested amount. The predetermined periods of time may be the same or they may be different. The predetermined periods of time may be based on one or more factors. For example, the predetermined periods of time may depend upon the total amount of use solution to be prepared, the total amount of chemical product to be dispensed, the type of chemical product (some chemical products may erode/dissolve more quickly or more slowly than others and thus dispense more quickly or more slowly than others), the temperature of the diluent, the pressure of the diluent spray, the end-use application of the use solution, etc.

The controller again samples the container weight information (234). If the target weight of the use solution is not satisfied (236), the process initiates another spray on/off cycle (232). This process repeats until the difference between the target weight of the use solution and the weight of the use solution in the container satisfies a threshold (236). The process may then wait for a settling time to elapse during which any remaining diluent/use solution may drain from the dispenser housing into the container (238).

The controller may also generate a message indicating that the use solution is complete (240). For example, the controller may generate a message indicating one or more details concerning the use solution such as the total volume of use solution prepared, the concentration of the use solution (by individual active ingredient, if applicable), the total amount of chemical product dispensed, the time and date that the use solution was prepared, a batch number, the name of the user requesting the use solution, etc. The message may be displayed on the dispensing system user interface or on one or more local or remote computers. In addition or alternatively, the message may be sent as an electronic communication via e-mail, voice mail, text message, cell phone, pager, PDA, lap top computer or via some other form of electronic communication.

Figure 8:
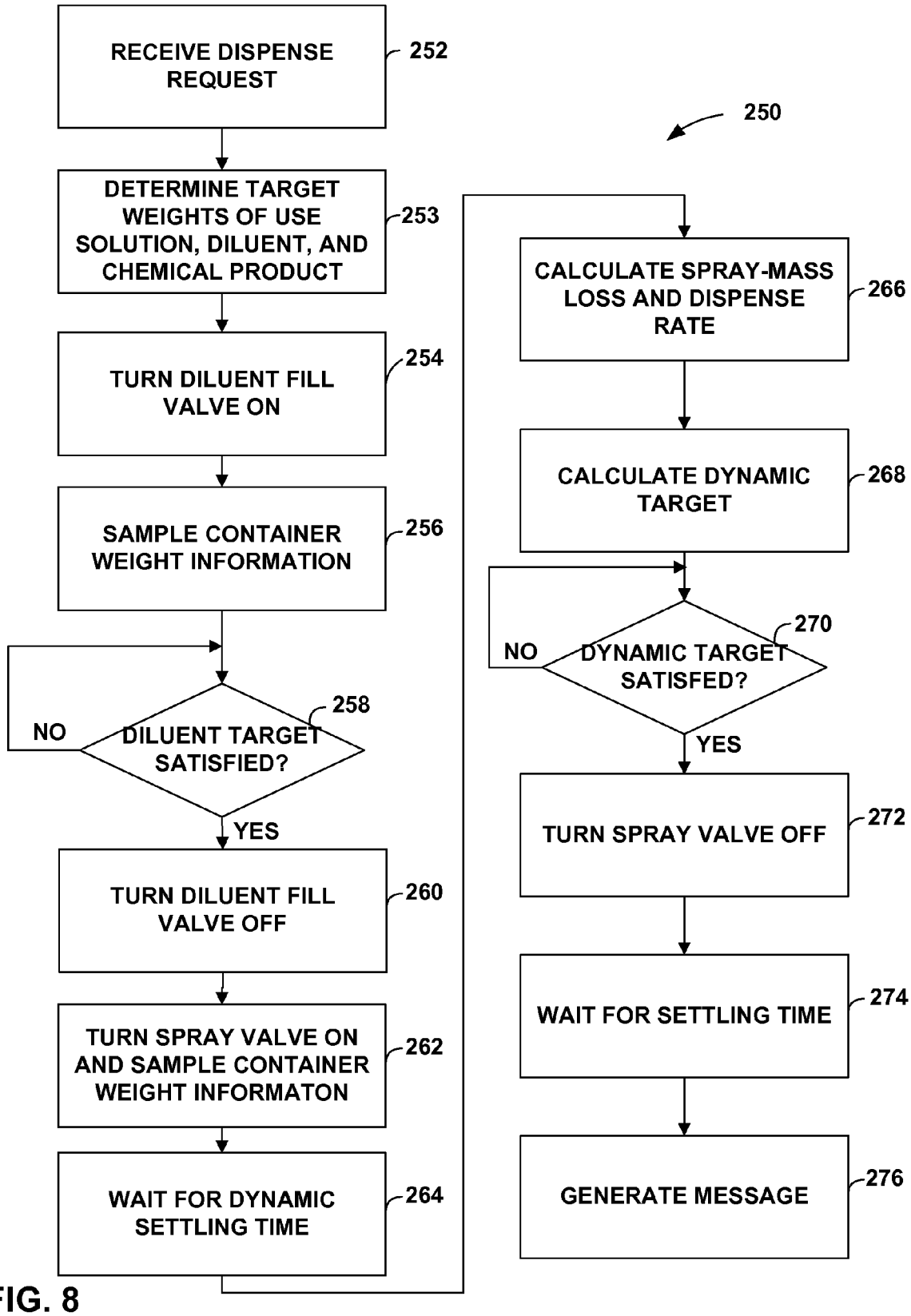
FIG. 8 is a flow chart illustrating an example adjusted single-shot dispense process by which the system may create a use solution of a desired concentration.

FIG. 8 is a flow chart illustrating an example process (250) by which a dispensing system may prepare a use solution using the adjusted single-shot dispense mode. The system controller receives a dispense request (252). The controller determines a target weight of the requested use solution, a target weight of the diluent required to prepare the requested use solution and a target weight of the chemical product required to prepare the requested use solution (253). The controller turns on the diluent fill valve (254) and samples the container weight information to determine the actual weight of the diluent in the container (256). The controller compares the difference between the target weight of diluent and the actual weight of the diluent in the container until the difference satisfies a threshold (258). The controller then turns off the diluent fill valve (260).

To dispense the chemical product, the controller applies the diluent from the container to the chemical product and begins to sample the container weight information (262). The controller waits for a period of time referred to as the dynamic settling time (264). In some examples, this is a defined period of time after initiation of the dispensing spray (e.g., time 128 in FIG. 5) sufficient to calculate the spray-mass loss and the rate of weight increase of the container during dispensation of the chemical product (e.g., the slope of curve 122 in FIG. 5). The dynamic settling time may be predefined or it may be determined in real time based on the container weight information. The controller calculates the spray-mass loss; that is, the difference between the actual weight of the diluent in the container that satisfied the target weight and the minimum weight of the container after dispensing of chemical product has begun (266). The controller also calculates the dispense rate of the chemical product by determining the rate of weight increase of the container per unit time (266). The dispense rate may be determined at a single point in time or it may be averaged over two or more points in time.

The single-shot dynamic target is determined (268). The single-shot dynamic target may be calculated by, for example, calculating the difference between the target weight of the requested use solution and the spray-mass loss. The controller compares the difference until the single-shot dynamic target threshold is satisfied (270). When the single-shot dynamic target is satisfied, the controller turns off the spray valve to discontinue application of the diluent/use solution to the chemical product (272). The process may then wait for a settling time to elapse during which any remaining diluent/use solution may drain from the dispenser housing into the container (274). The process may also generate a message as described above indicating that the use solution is complete (276).

The multi-shot dispense mode uses a process similar to that described in FIG. 8. However, instead of the single-shot dynamic target, a multi-shot dynamic target may be determined by, for example, calculating a predetermined percentage of the difference between the target weight of the diluent and the spray-mass loss. In multi-shot dispense mode, the process represented by steps (260)-(274) may be repeated multiple times until the multi-shot dynamic target is satisfied. During the multi-shot dispensing process, progressively smaller and smaller amounts of chemical product would likely be dispensed with each iteration as the amount of use solution in the container becomes closer to the target. Also, the predetermined percentage may vary with each iteration; for example, the percentage may become successively smaller with each iteration. The multi-shot dispense mode may provide more accurate dispensing in some circumstances; for example, the controller has more than one opportunity to learn and adjust based upon more than one dispense to reduce the amount of overshoot from the target.

The examples described herein may be used to prepare use solutions having use in cleaning applications such as medical instrument cleaning, food processing, warewashing or laundry. However, it is to be recognized and understood that the techniques described herein have usefulness in other applications as well, and that the disclosure is not limited in this respect.

The techniques described in this disclosure, including functions performed by a controller, control unit, or control system, may be implemented within one or more of a general purpose microprocessor, digital signal processor (DSP), application specific integrated circuit (ASIC), field programmable gate array (FPGA), programmable logic devices (PLDs), or other equivalent logic devices. Accordingly, the terms "processor" or "controller," as used herein, may refer to any one or more of the foregoing structures or any other structure suitable for implementation of the techniques described herein.

The various components illustrated herein may be realized by any suitable combination of hardware, software, firmware. In the figures, various components are depicted as separate units or modules. However, all or several of the various components described with reference to these figures may be integrated into combined units or modules within common hardware, firmware, and/or software. Accordingly, the representation of features as components, units or modules is intended to highlight particular functional features for ease of illustration, and does not necessarily require realization of such features by separate hardware, firmware, or software components. In some cases, various units may be implemented as programmable processes performed by one or more processors or controllers.

Any features described herein as modules, devices, or components may be implemented together in an integrated logic device or separately as discrete but interoperable logic devices. In various aspects, such components may be formed at least in part as one or more integrated circuit devices, which may be referred to collectively as an integrated circuit device, such as an integrated circuit chip or chipset. Such circuitry may be provided in a single integrated circuit chip device or in multiple, interoperable integrated circuit chip devices.

If implemented in part by software, the techniques may be realized at least in part by a computer-readable data storage medium comprising code with instructions that, when executed by one or more processors or controllers, performs one or more of the methods described in this disclosure. The computer-readable storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), embedded dynamic random access memory (eDRAM), static random access memory (SRAM), flash memory, magnetic or optical data storage media. Any software that is utilized may be executed by one or more processors, such as one or more DSP's, general purpose microprocessors, ASIC's, FPGA's, or other equivalent integrated or discrete logic circuitry.

Various examples have been described. These and other examples are within the scope of the following claims.

The invention claimed is:

1. A system comprising:

a container into which a target weight of a diluent required to prepare a requested amount of a use solution is dispensed;

a weighing device positioned to obtain container weight information concerning a weight of the container and any contents thereof; and a controller that receives a dispense request specifying the requested amount of the use solution to be prepared and a requested concentration of a chemical product in the use solution, determines the target weight of the diluent required to prepare the requested amount of the use solution, determines a target weight of the chemical product to be dispensed required to prepare the requested amount of the use solution, and manages application of the diluent onto the chemical product until an amount of the use solution in the container satisfies the requested amount based on the container weight information, wherein the controller further initiates a spray on/off cycle including spraying the chemical product with at least some of the diluent from the container for a first predetermined period of time and stops the spraying of the solid chemical product for a second predetermined period of time, receives the container weight information, determines a weight of the use solution in the container from the container weight information, compares the difference between a target weight of the requested use solution and the weight of the use solution in the container with a threshold, and repeats the spray on/off cycle until the threshold is satisfied.

2. The system of claim 1 wherein the chemical product comprises one of a solid block of chemical product concentrate, pellets, tablets, a cast product, or an extruded product.

3. The system of claim 1 wherein the weighing device comprises one or more load cells.

4. The system of claim 1 further comprising a liquid circulation subsystem that draws diluent from the container and sprays the diluent onto a solid chemical product to be dispensed and directs the resulting use solution back into the container.

5. The system of claim 1 wherein the controller further:

electronically controls a valve through which the diluent is dispensed into the container;

receives the container weight information;

determines a weight of the diluent in the container from the container weight information;

compares the weight of the diluent in the container to the target weight of the diluent required to prepare the requested use solution; and electronically controls the valve to stop dispensation of the diluent into the container based on the comparison.

6. The system of claim 1 further comprising a memory that stores dispenser settings.

7. The system of claim 1 further comprising a memory that stores at least one of a timed dispense module, an adjusted single-shot dispense module, and an adjusted multi-shot dispense module.

8. The system of claim 7 wherein the timed dispense module controls dispensation based on a spray on/off cycle comprising application of the diluent to the chemical product for a first predetermined period of time, stopping application for a second predetermined period of time, and repeating the spray on/off cycle until the amount of use solution in the container satisfies the requested amount.

9. The system of claim 7 wherein the adjusted single-shot dispense module controls dispensation based on a determination of a current dispense rate and a prediction of a time at which the actual amount of use solution in the container satisfies the requested amount of use solution.

10. The system of claim 7 wherein the adjusted multi-shot dispense module controls dispensation based on a determination of a current dispense rate and a prediction of a time at which the actual amount of use solution in the container satisfies a predetermined percentage of the requested amount of use solution.

11. A system comprising:

a container into which a target weight of a diluent required to prepare a requested amount of a use solution is dispensed;

a weighing device positioned to obtain container weight information concerning a weight of the container and any contents thereof; and a controller that receives a dispense request specifying the requested amount of the use solution to be prepared and a requested concentration of a chemical product in the use solution, determines the target weight of the diluent required to prepare the requested amount of the use solution, determines a target weight of the chemical product to be dispensed required to prepare the requested amount of the use solution, and manages application of the diluent onto the chemical product until an amount of the use solution in the container satisfies the requested amount based on the container weight information, wherein the controller further:

controls spraying of the chemical product with at least some of the diluent from the container;

samples the container weight information;

determines a weight of the use solution in the container from the container weight information;

after a dynamic settling time has elapsed, determines a dispense rate corresponding to an amount of the chemical product dispensed per unit time based on a change in the weight of the use solution in the container;

determines a dynamic target weight of the use solution in the container based on a target weight of the requested use solution;

determines a dynamic cycle time based on the dynamic target and the dispense rate; and stops the spraying of the chemical product after the dynamic cycle time has elapsed.

12. The system of claim 11 wherein the weighing device comprises one or more load cells.

13. The system of claim 11 further comprising a liquid circulation subsystem that draws diluent from the container and sprays the diluent onto a solid chemical product to be dispensed and directs the resulting use solution back into the container.

14. The system of claim 11 wherein the controller further:

electronically controls a valve through which the diluent is dispensed into the container;

receives the container weight information;

determines a weight of the diluent in the container from the container weight information;

compares the weight of the diluent in the container to the target weight of the diluent required to prepare the requested use solution; and electronically controls the valve to stop dispensation of the diluent into the container based on the comparison.

15. The system of claim 11 wherein the chemical product comprises one of a solid block of chemical product concentrate, pellets, tablets, a cast product, or an extruded product.

* * * * *